United States Patent [19]

Kelm

[11] 4,142,395

[45] Mar. 6, 1979

[54] BENDING MACHINE

[75] Inventor: Reinhold Kelm, Daaden, Fed. Rep. of Germany

[73] Assignee: Baumgarten Montage GmbH, Weitefeld, Fed. Rep. of Germany

[21] Appl. No.: 777,712

[22] Filed: Mar. 15, 1977

[30] Foreign Application Priority Data

Mar. 15, 1976 [DE] Fed. Rep. of Germany ..... 2610774

[51] Int. Cl.[2] ..... B21D 5/04

[52] U.S. Cl. ..... 72/319

[58] Field of Search ..... 72/296, 310, 319, 320, 72/321, 322

[56] References Cited

U.S. PATENT DOCUMENTS

| | | | |
|---|---|---|---|
| 941,783 | 11/1909 | Keene | 72/319 |
| 1,402,801 | 1/1922 | Schott | 72/319 |
| 2,478,854 | 8/1949 | Webb | 72/319 |
| 2,687,162 | 8/1954 | Smith | 72/321 |
| 2,905,224 | 9/1959 | Allison | 72/319 |
| 3,380,280 | 4/1968 | Wise | 72/319 |

*Primary Examiner*—Michael J. Keenan

*Attorney, Agent, or Firm*—Norman S. Blodgett; Gerry A. Blodgett

[57] ABSTRACT

Machine for bending sheet metal, consisting of an upper and a lower clamp plate for holding the sheet metal and a bending plate which is swingable about an axis located between the clamp plates for forming the sheet metal.

5 Claims, 8 Drawing Figures

BENDING MACHINE

BACKGROUND OF THE INVENTION

Folding or bending presses belong to the state of the art, which presses have upper, lower, and bending side plates may be arranged vertically of each other and the bending side plate is swingable upwardly about a support axis by means of a mechanical drive mounted on the upper side plate for the execution of the bending operation.

The design of the such known folding or bend presses is complicated, because in order to achieve exceptional results, it is necessary to make not only the upper and lower side plate adjustable relative to each other, but also to make possible an exact adjustment of the hinge axis of the bending side plate for different sheet metal thickness. For this reason, the common folding or bending presses are expensive and, therefore, are only economical when continuously used in production shops. For home and model working, when bending parts are often needed, but not at all times, the known folding and bending presses are not suitable.

These and other difficulties experienced with the prior art devices have been obviated in a novel manner by the present invention.

It is, therefore, an outstanding object of the invention to provide this type of machine for bending of sheet metal that is also possible to use for home and model working.

Another object of this invention is the provision to create a folding and bending press of the above-described type which is light in weight, which is also rugged, and additionally is of a design which needs little installation space and may be easily stored when not in use.

SUMMARY OF THE INVENTION

In general, the present invention consists of a machine in which the upper and lower side plates are directly connected with each other by cross guides and are adjustably connected relative to each other. One of the cross guides carries swing supports for a bending side plate, as well as welded members for fastening it, for example, to the frame. The bending side plate consists of a rolled or drawn angle or U-profile. It has been found to be particularly practical, when expanding the invention, to make the upper side plate of an unsymmetrical trapezoidal profile and to make the lower side plate with a sharp-angled triangular profile.

More specifically, an important characteristic of the invention lies in the fact that the bending side plate is fastened to the carrier arm, is swingably held on support pins or operating levers, and may be fastened by a clamping device in any angular position. With this arrangement, it is possible each time to make an exact adjustment of the folding or bending press for the different sheet metal thicknesses without the relative position entering between the swing axis for the bending side plate and the upper and lower side plate fastened on the axis.

The clamping devices may be designed most simply as semi-circular slots within the operating levers with penetrating clamping bolts fastened to the carrier arms.

In designing the holding members, it has been found to be of advantage that they are designed as angles fastened to the lower side plate. The horizontal leg of the angle forms a support and the vertical leg forms an attachment area for clamping to the work bench, such as, for example, a small work bench as used by home workers or model makers. Such small work benches are described, for example, in the patents DT-OS 1962 965 and DT-Gbm 6 948 543.

The transverse guides for the upper and lower side plates can be made from bolts, according to the invention, which are fixedly mounted on the lower side plate and engage holes in the upper side plate. The upper side plate is thereby adjustable by adjusting nuts relative to the lower side plate against spring forces.

Finally, according to this invention, it is suggested that the operating levers arranged on both ends of the bending plate be connected to each other by an engagement rod. In that way the adjusting forces for the bending side plate are brought to act along the entire length.

Figure 1:
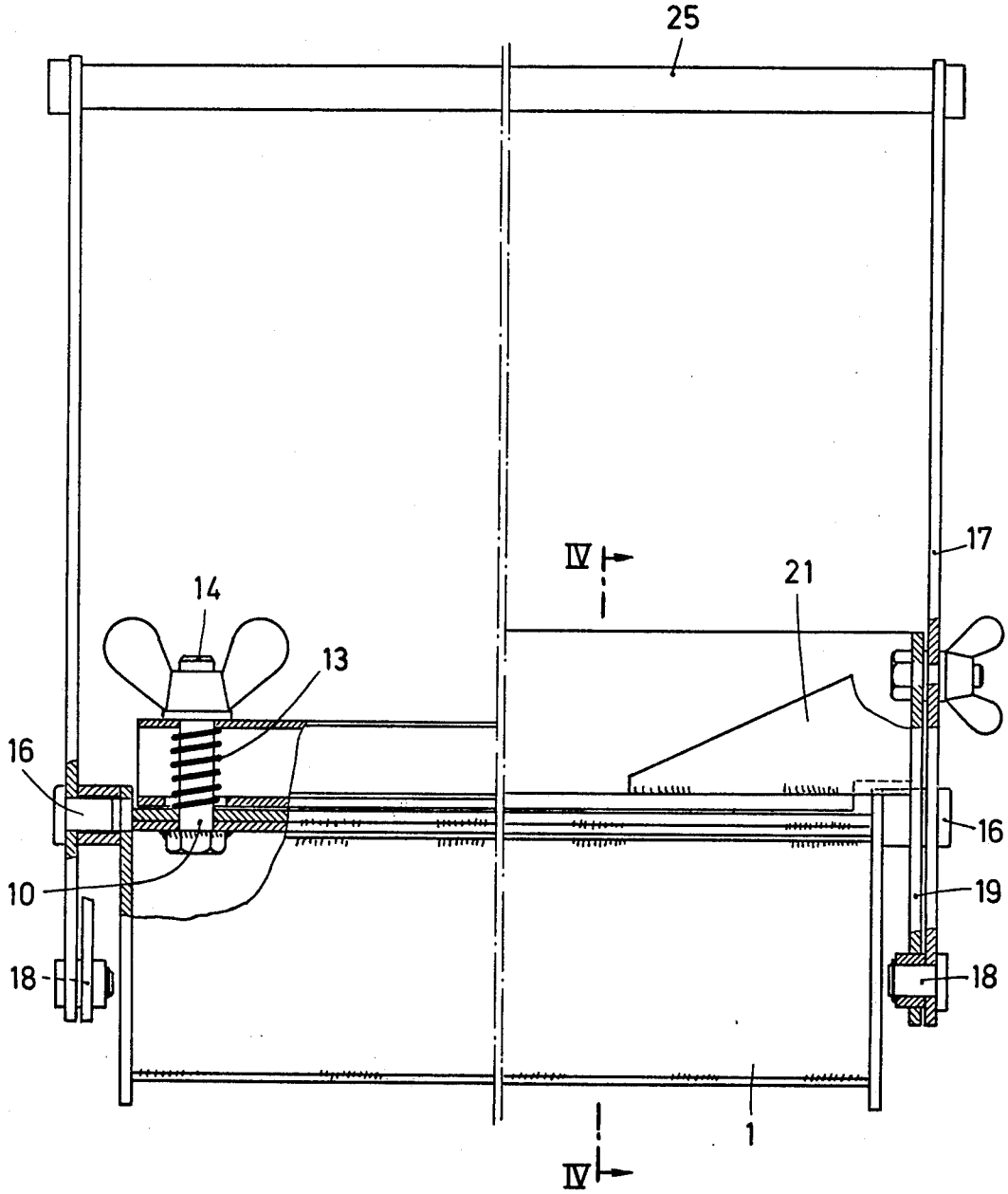
FIG. 1 is a front elevational view partially in section of the bending machine.
Figure 2:
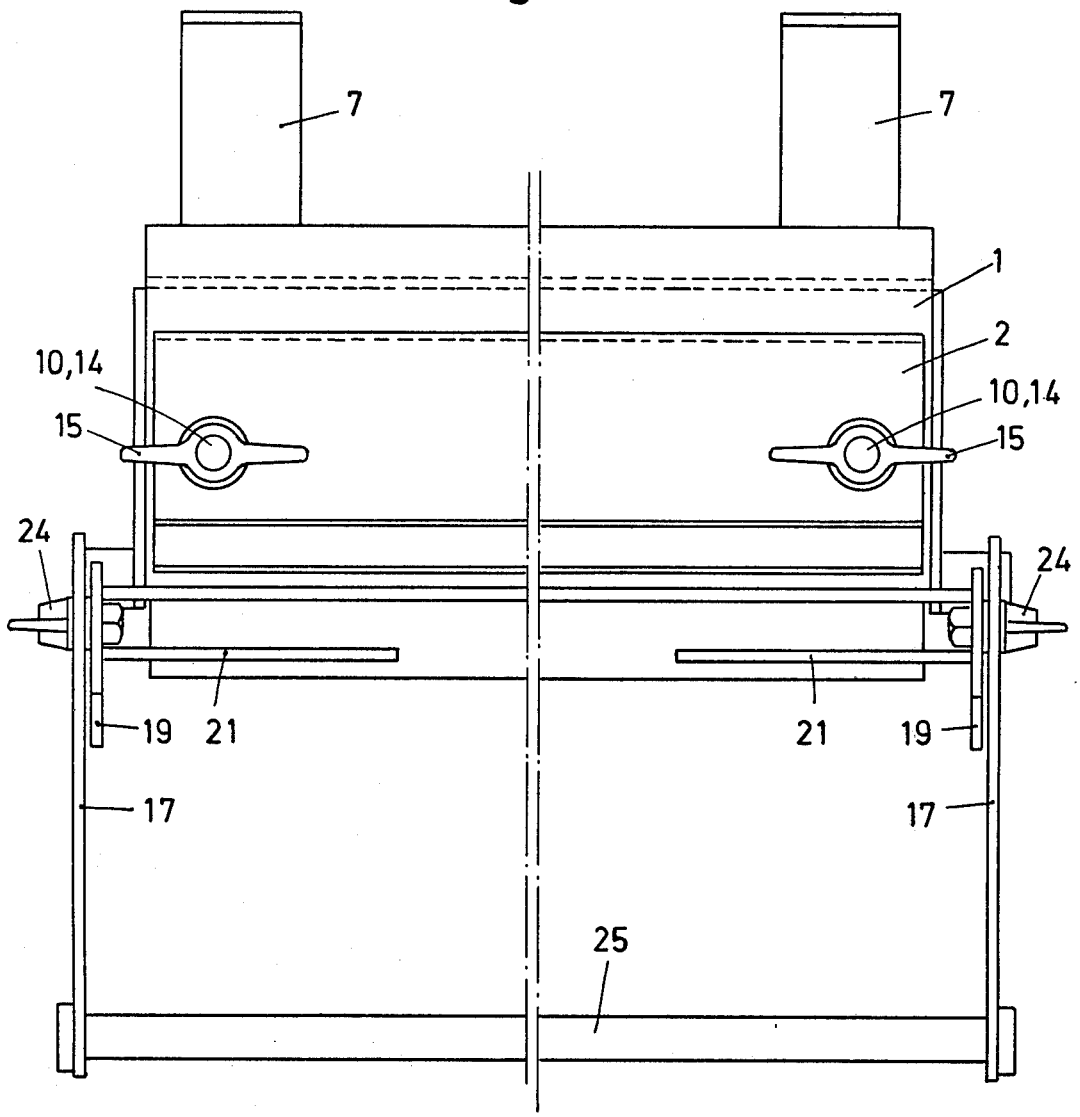
FIG. 2 is a plane view of the bending machine.
Figure 3:
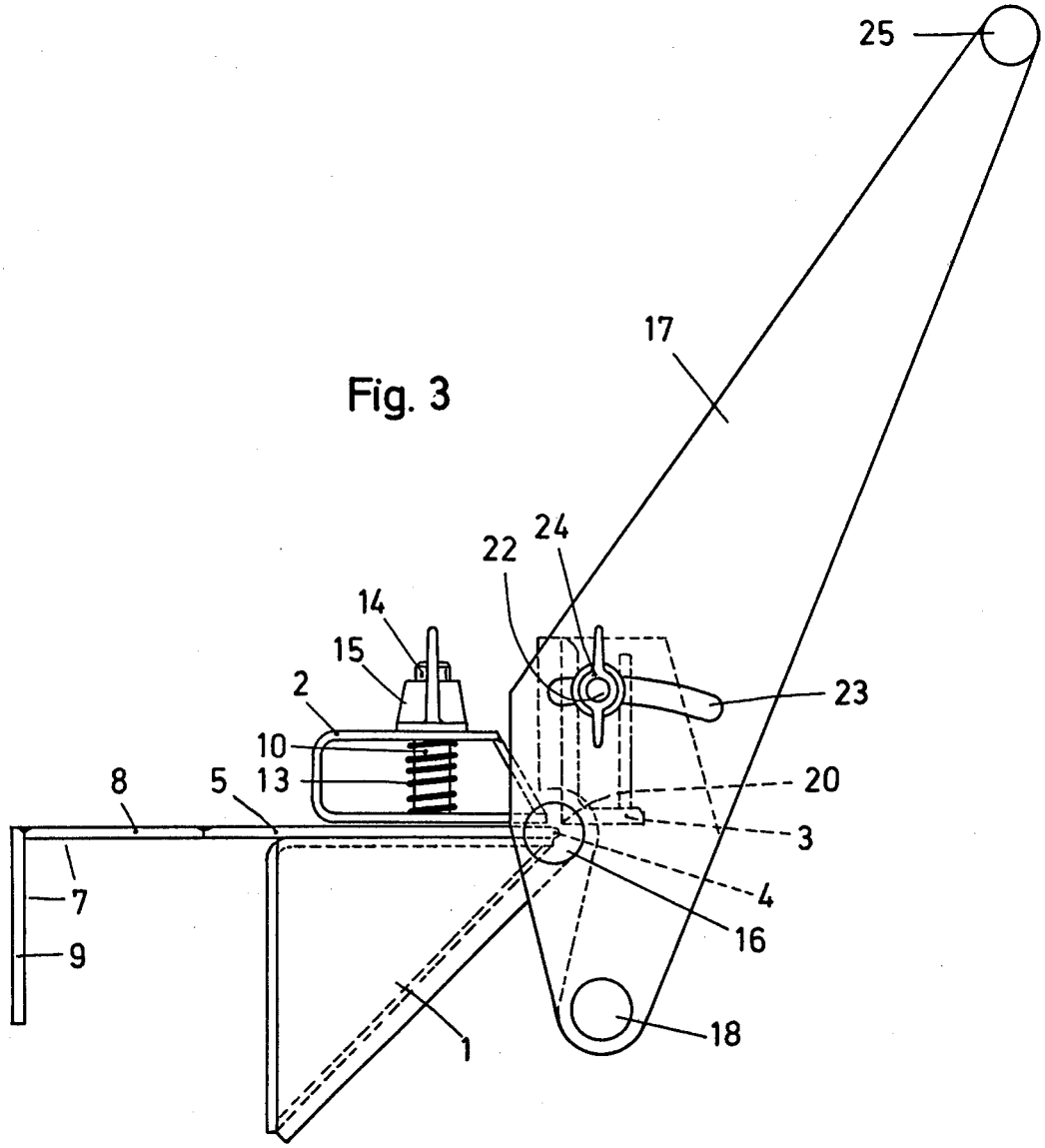
FIG. 3 is a side elevational view of the bending machine.
Figure 4:
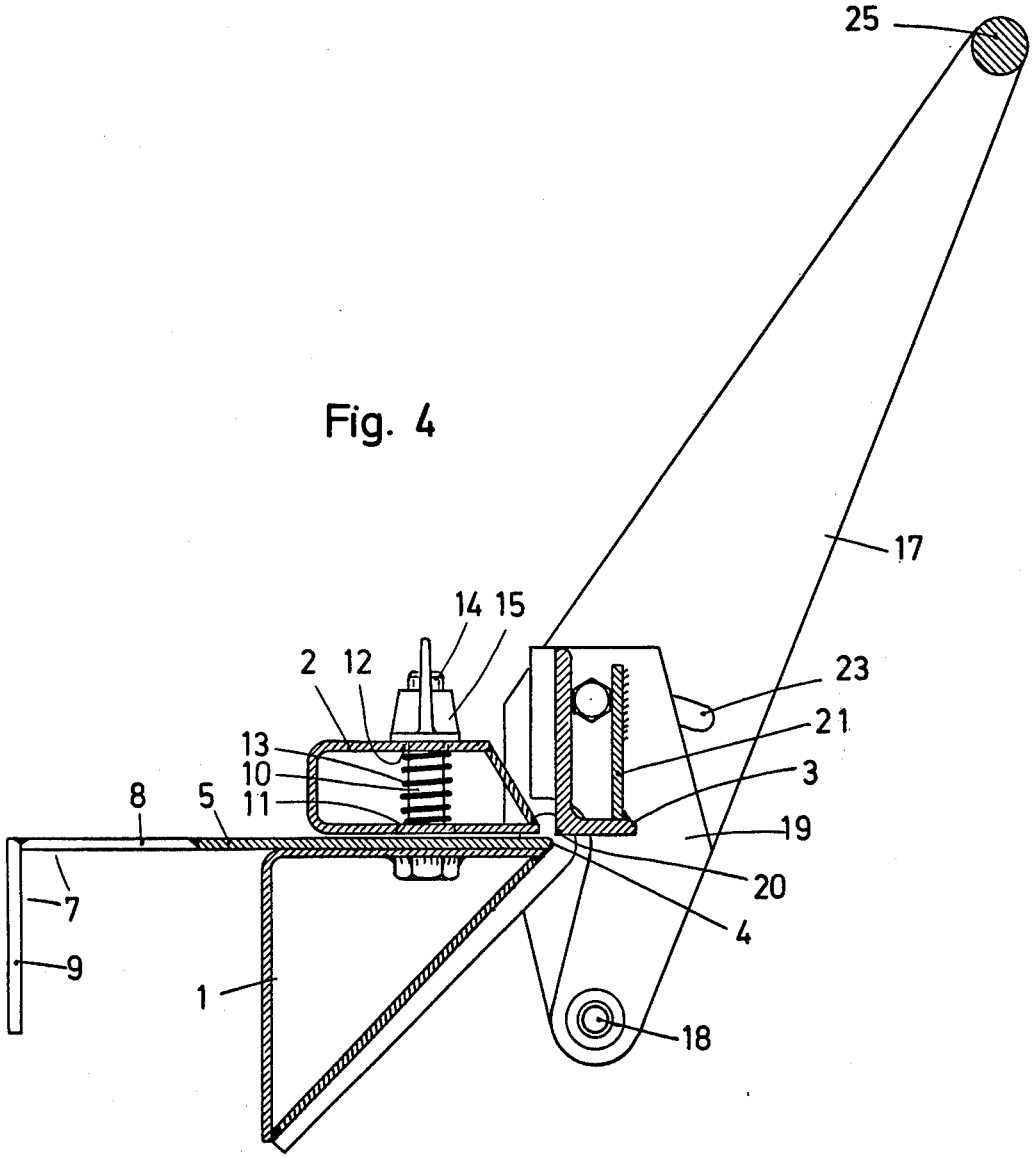
FIG. 4 is a vertical sectional view of the bending machine taken on the line IV—IV of FIG. 1, and FIGS. 5 to 8 show different positions of the bending machine.

The character of the invention, however, may be best understood by reference to one of its structural forms, as illustrated by the accompanying drawings, in which:

DESCRIPTION OF THE PREFERRED EMBODIMENT

The drawings show the important parts of the bending machine for the bending operation, including a lower plate 1, an upper part 2, and a bending plate 3. The lower plate 1 is formed as a box-shaped hollow profile having the cross-section of an acute-angled triangle and is preferably made from sheet metal parts. The upper plate 2 is also designed as a box-shaped hollow profile made from sheet metal and is of unsymmetrical trapezoid cross-section.

A bending edge 4 is located on the lower plate 1 on a flap 5 made of rugged material welded to the upper surface of the lower plate. The bending edge 4 is rounded with a small radius which corresponds approximately to half the sheet metal thickness and is arranged in such a way that it protrudes somewhat over the front edge of the lower plate 1. On the oppositely positioned longitudinal edge of the plate 5 are arranged two angle-shaped holding members 7 with one leg 8 extending in the same plane as plate 5 and the other leg 9 extending at a right angle to the plate 5 spaced from and parallel to the back wall of the lower plate 1.

To the lower plate 1 are fixedly mounted two cross guides in the form of bolts 10 which extend vertically above the upper surface of the lower plate 1.

The upper plate 2 is also formed as a box-shaped hollow profile made from sheet metal parts and is of unsymmetrical shape, wherein the sharp-angled edge of the trapezoidal cross-section is located beside the bending edge 4.

The bolts 10 forming the cross guides engage holes 11 and 12 in the upper plate 2 and are surrounded by pressure coil spring 13 which are supported at one end on the upper surface of the lower plate 1 and at the other end of the upper cross wall of the upper plate 2.

The upper ends of the bolts 10 are equipped with threads 14 on which are located adjusting nuts 15, such as wing nuts. With the help of the adjusting nut 15, the upper plate 2 may be placed under tension against the force of the spring 13 and upper surface of the lower plate 1. The lower plate 1 and the upper plate 2 form in this way the clamping means for the bending of sheet metal and the like.

On the ends of the lower plate 1 are mounted supports 16 which are lined up with the bending edge 4 and which carry operating arms 17 which are swingable. On each of the two operating arms 17 is supported a carrier arm 19 which swingable (but is limited in movement) on a support pin 18, but eccentrically of the supports 16, whereby the bending plate 3 is held between the two carrier arms 19. The bending plate 3 consists of a rolled or drawn angle profile whose outer leg areas form together a sharp-angled edge 20. This angle shape is, on one side, has both legs welded to the carrier arm 19 and, on the other side is connected by additional gusset plates 21 to the carrier arms 19. Each of the carrier arms 19 carries a threaded bolt 22 which penetrates an arcuate slot 23 formed in the operating lever 17; the axis of the slot arc is coincident with the axis of the support pin 18. An adjusting nut 24, such as a wing nut, is mounted on the threaded bolt 22 and forms a clamping device with the operating arm 17. With their help, the carrier arms 19 (and therefore the bending plate 3) may be fixed in any relative angular position relative to the operating arms 17.

The support pin 18 for the carrier arms 19 is arranged eccentrically of the support pins 16 of the operating levers 17. This makes it possible to adjust the distance the bending side plate 3 are located relative to the bending edge 4 in accordance with different sheet metal thicknesses. The eccentrically adjustable support of the bending plate 3 on the operating levers 17, however, causes the start of the bending operation to be displaced relative to the upper and lower plates in such a way that the starting position of the operating levers 17 is close in the vertical position when the distance between the bending plate 3 and the bending edge 4 is adjusted to be greater. This fact, however, is no hindrance to the operation of the operating levers, because it is done by hand.

With the help of holding member 7, the whole folding and bending machine is fastened to a work bend with clamps. The clamps grip the vertical leg 9 of the holding member and the horizontal leg 8 is supported on the vise of the work bench. Also, the rear surface of the lower plate 1 leans against the front side of the vise, so that the whole folding and bending machine is very stable on the work bench.

Figure 6:
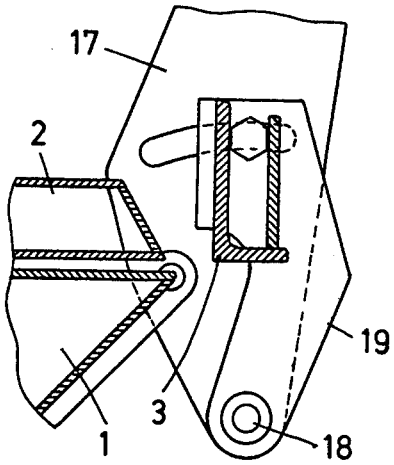
Figure 7:
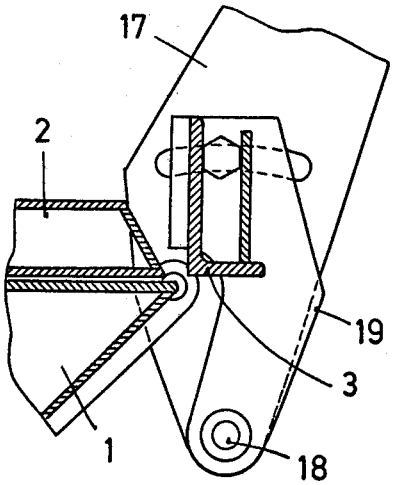
Figure 8:
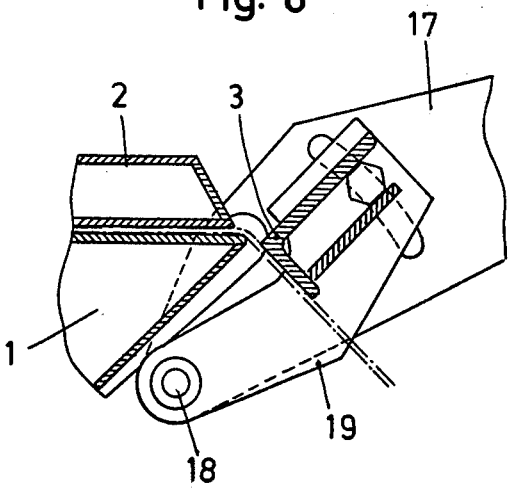

In the upper position of the operating lever 17, as can be seen in FIGS. 6 and 7, the sheet metal to be bent is pushed between the upper plate 2 and lower plate 1, so that only the part extends over the bending edge 4 which is to be bent. Thereafter, by operating the clamp screws 15, the upper plate 2 is adjusted relative to the lower plate 1 and, consequently, the sheet metal is tightly secured. The operating arms 17 now must be moved upwardly by the connecting handle rod 25 (as can be seen in FIG. 8) to bend the sheet metal around the bending edge 4 of the lower plate 1. The bending angle depends on the extent of the swing angle of the operating levers 17 and may be limited by adjustable stops mounted to the lower plate 1 in accordance with demand.

Figure 5:
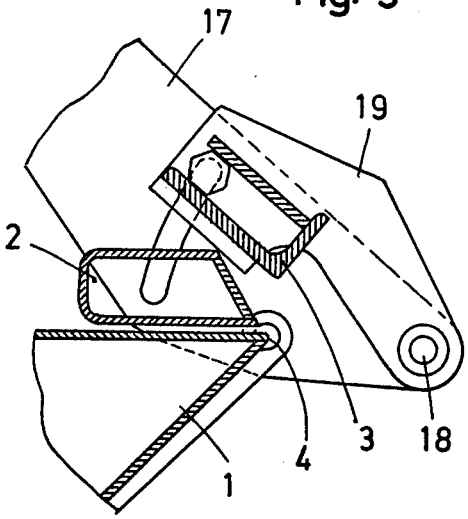

It should be mentioned that the adjustability of the carrier arms 19 relative to the operating levers 17 is selected to be of such a dimension that the bending plate 3 (with the help of the operating levers 17) can rest against the upper plate 2, as can be seen in FIG. 5. In this way, the bending machine may be folded when not in use and be stored away with little use of space.

Naturally, variations of the described bending machine are also possible. For example, the clamping devices, which adjust the plates 1 and 2 relative to each other, may have other means in place of the adjusting nuts, such as an eccentric device or wedges. Also, the adjusting means for the carrier arms 19 for the bending plate 3 may have (in place of clamping devices) arresting devices. Finally, it should also be possible to mount the bending machine on a frame.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed new and desired to secure by Letters Patent is:

1. Folding and bending machine for sheet metal workpieces, comprising:

(a) a lower plate having a longitudinal bending edge constituting the bending axis of a workpiece, (b) an upper plate adjustably mounted with respect to the bottom plate for accommodating workpieces of different thicknesses in a plane extending between the upper and lower plates, (c) an operating arm pivotally mounted about the axis of the bending edge, (d) a carrier arm mounted to the operating arm for pivoting about a swinging axis spaced from the bending axis, (e) a bending plate mounted on the carrier arm and spaced from the pivoting axis so that upon pivoting of the operating arm, the bending plate intersects the plane extending between the upper and lower plates, and (f) means for clamping the carrier arm to the operating arm for varying the angular position of the carrier arm with respect to the operating arm and consequently varying the distance between the bending plate and bending axis at the point of intersection between the bending plate and a workpiece lying in the plane extending between the upper and lower plates.

2. Folding and bending machine as recited in claim 1, wherein the clamping means for the carrier arm comprises:

(a) a slot in the operating arm extending along a radial arc swung from the swinging axis, and (b) a releasable fastener extending through the carrier arm and the slot.

3. Folding and bending machine as recited in claim 1, wherein the means for adjustably mounting the upper plate with respect to the bottom plate comprises:

(a) a plurality of bolts extending vertically through the lower and upper plates, each bolt having a threaded and extending above the upper plate, (b) adjusting nuts on the threaded ends of the adjusting bolts, and (c) means for biasing the upper plate away from the lower plate.

4. Folding and bending machine as recited in claim 3, wherein the upper and lower plates consist of box-shaped construction having hollow cross sections.

5. Folding and bending machine as recited in claim 4, wherein the cross section of the upper plate is an unsymmetrical trapezoid and the cross section of the lower plate is an acute triangle.

* * * * *